US006725587B2

(12) United States Patent
Collins

(10) Patent No.: US 6,725,587 B2
(45) Date of Patent: Apr. 27, 2004

(54) COMBINATION ENVELOPE AND GREETING CARD

(75) Inventor: Robert W. Collins, Shawnee, KS (US)

(73) Assignee: Winkler & Dunnebrier, AG (DE)

( * ) Notice: Subject to any disclaimer, the term of this patent is extended or adjusted under 35 U.S.C. 154(b) by 0 days.

(21) Appl. No.: 09/892,930

(22) Filed: Jun. 27, 2001

(65) Prior Publication Data

US 2003/0000118 A1 Jan. 2, 2003

(51) Int. Cl.[7] ..... G09F 1/00
(52) U.S. Cl. ..... 40/124.06; 40/789
(58) Field of Search ..... 40/124.06, 124.09, 40/124.01, 774, 786, 788, 789, 155; 229/75; 206/232

(56) References Cited

U.S. PATENT DOCUMENTS

| | | | | | |
|---|---|---|---|---|---|
| 460,264 | A | * | 9/1891 | Lavette | 229/75 |
| 3,026,018 | A | | 3/1962 | Stratton et al. | |
| 3,151,803 | A | | 10/1964 | Kaminski | |
| 3,174,244 | A | * | 3/1965 | Walton | 229/82 |
| 3,265,289 | A | | 8/1966 | Hiersteiner | |
| 3,310,225 | A | | 3/1967 | Hoblit | |
| 3,380,648 | A | | 4/1968 | De Lyra | |
| 3,489,332 | A | | 1/1970 | Knittel | |
| 4,244,511 | A | * | 1/1981 | Coleman | 229/92.1 |
| 4,294,400 | A | * | 10/1981 | Gendron | 229/67.3 |
| 4,354,631 | A | | 10/1982 | Stevenson | |
| 4,433,780 | A | * | 2/1984 | Ellis | 206/232 |
| 4,436,202 | A | | 3/1984 | Berkley | |
| 4,441,625 | A | | 4/1984 | Andersson | |
| 4,510,621 | A | | 4/1985 | Sak et al. | |
| 4,584,201 | A | | 4/1986 | Boston | |
| 4,690,322 | A | | 9/1987 | Burns | |
| 4,715,531 | A | | 12/1987 | Stewart et al. | |
| 5,002,220 | A | | 3/1991 | Safranski | |
| 5,071,061 | A | | 12/1991 | Willis | |
| 5,213,258 | A | | 5/1993 | Kim | |
| 5,226,532 | A | * | 7/1993 | Davidson et al. | 206/232 |
| 5,236,121 | A | * | 8/1993 | Wollman et al. | 229/68.1 |
| 5,277,361 | A | | 1/1994 | Stude | |
| 5,400,957 | A | * | 3/1995 | Stude | 229/302 |
| 5,487,566 | A | * | 1/1996 | Hedge, Jr. | 281/15.1 |
| 5,626,282 | A | | 5/1997 | Lewis | |
| 5,687,903 | A | | 11/1997 | Akridge et al. | |
| 5,738,274 | A | | 4/1998 | Stude | |
| 5,875,964 | A | | 3/1999 | Pham | |
| 6,032,854 | A | | 3/2000 | Greer et al. | |
| 6,070,719 | A | * | 6/2000 | Pollock | 206/232 |
| 6,070,792 | A | | 6/2000 | Foushee | |
| 6,427,371 | B2 | * | 8/2002 | Olson et al. | 40/789 |

* cited by examiner

*Primary Examiner*—Frantz F. Jules
(74) *Attorney, Agent, or Firm*—Shook, Hardy & Bacon LLP

(57) ABSTRACT

A combination envelope and greeting card having a detachable card structure which is removable from the envelope and can function separately as a greeting card. Portions of some of the panels of the envelope can be separated from the envelope along lines of perforation, forming cards having two or more panels. The combination envelope and greeting card structure can also comprise a detachable display strip which includes an adhesive display assembly for securing the card structure when displayed in a standing position. Photograph retaining structures can also be included on one or more card panels.

12 Claims, 3 Drawing Sheets

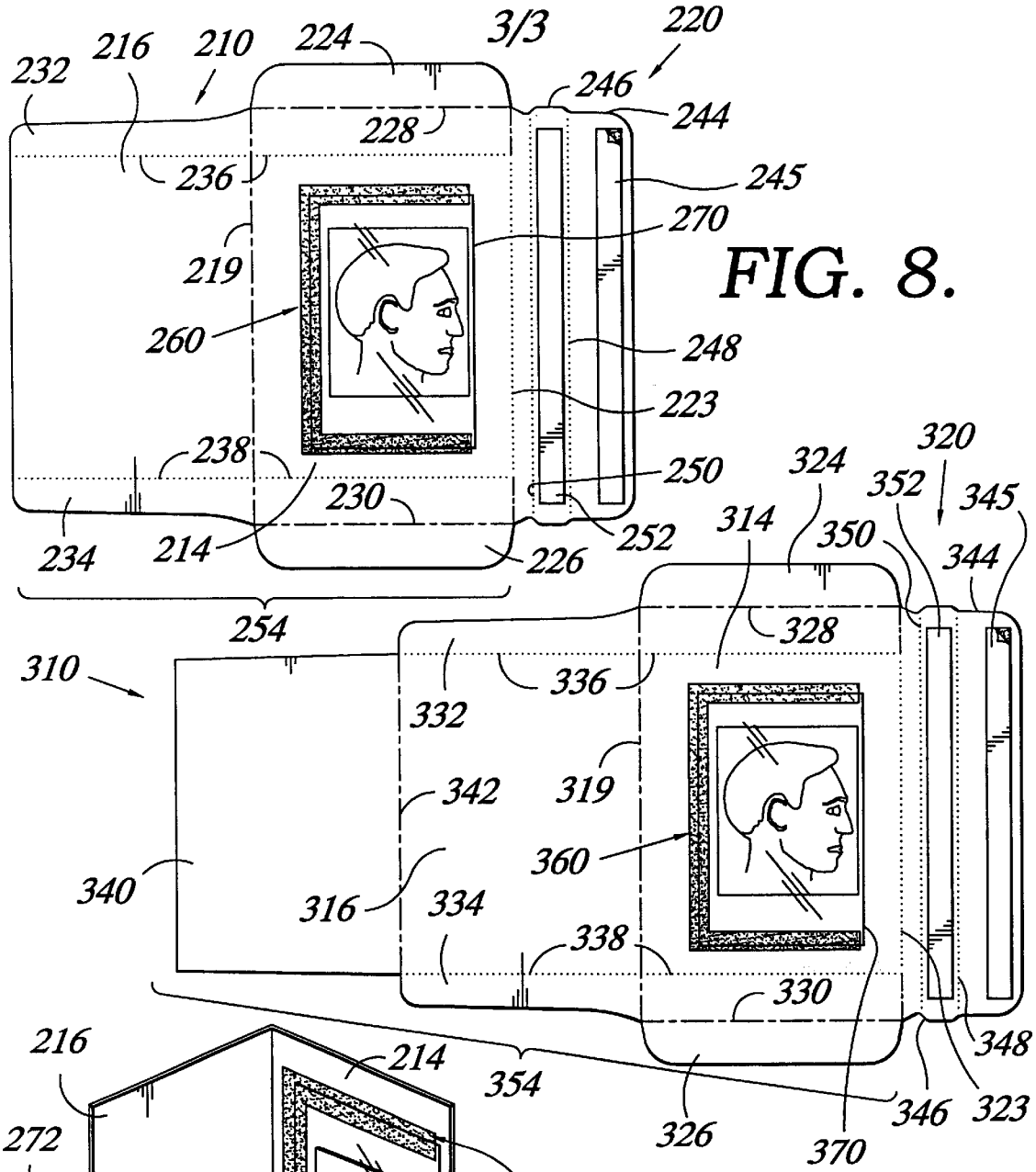
FIG. 8.
FIG. 9.
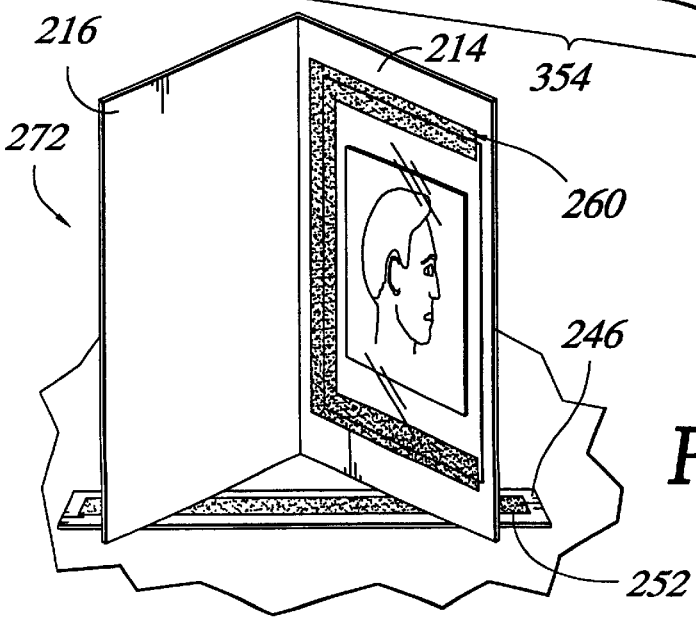
FIG. 10.

COMBINATION ENVELOPE AND GREETING CARD

CROSS-REFERENCE TO RELATED APPLICATIONS

None.

FIELD OF THE INVENTION

The present invention relates in general to envelopes, and more specifically, to envelopes having a greeting card combined therewith. In particular, this invention relates to an envelope and a greeting card made from a single envelope blank, wherein the greeting card is separable from the envelope by lines of perforation.

BACKGROUND OF THE INVENTION

In the greeting card industry, manufacturers must utilize not only the appropriate machinery for producing the cards, but also the appropriate machinery for producing the envelopes in order to affect cost savings. Thus, at a minimum, two expensive pieces of machinery, as well as two separate manufacturing processes, must be employed by the greeting card manufacturers to accomplish the task of manufacturing each greeting card.

In addition, standard bi-fold greeting cards are often displayed by their recipients by standing them up on a level surface. This method is not always satisfactory, as such a bi-fold card lacks adequate stability to withstand even light breezes, which can be caused by simply walking past the displayed card.

It is, therefore, an advantage of the present invention to provide a combination envelope and greeting card, wherein a single blank can be formed, on a single machine and in a single process, into both the mailing envelope and the greeting card.

It is another advantage of the present invention to provide an envelope which includes a greeting card, wherein upon opening the envelope and unfolding the card panels thereof, a greeting card is formed which can be separated from the envelope by lines of perforation.

It is yet another advantage of the present invention to provide a combination envelope and greeting card, which further includes a detachable display strip for displaying the greeting card in a stable manner.

Additional advantages, objects, and novel features of the invention will be set forth in part in the description which follows, and in part will become apparent to those skilled in the art upon examination of the following, or may be learned by practice of the invention.

SUMMARY OF THE INVENTION

The present invention comprises a combination envelope and greeting card formed from a single blank.

According to one embodiment of the present invention, a combination envelope and greeting card made from a blank is disclosed and comprises a front panel having opposed side edges and a back panel having opposed side edges, the front and back panels being connected along a line of perforation or a fold line, two side flap receiving panels extending from the back panel at the side edges thereof and connected thereto along a line of perforation, the side flap receiving panels adapted to receive a portion of the back panel when the blank is formed into an envelope, a seal flap structure extending from the front panel opposite the back panel and connected thereto at a fold line, and a detachable card structure, the detachable card structure comprising the back panel, and at least one additional panel extending from the back panel. The front panel can further comprise two side flaps extending from therefrom at the side edges thereof, each side flap connected to the front panel along a fold line. The seal flap structure can include an adhesive strip assembly and a detachable display strip portion.

BRIEF DESCRIPTION OF THE DRAWINGS

In the accompanying drawings which form a part of the specification and are to be read in conjunction therewith and in which like reference numerals are used to indicate like parts in the various views:

FIG. 8 is a plan view of an alternative embodiment of an envelope blank for use in construction of the combination envelope and greeting card of the present invention, which is adapted for use first as a mailing envelope and subsequently as a bi-fold greeting card which is capable of being displayed, showing a photograph retaining structure positioned on one of the card panels.

FIG. 9 is a plan view of another embodiment of an envelope blank for use in construction of the combination envelope and greeting card of the present invention, which is adapted for use first as a mailing envelope and subsequently as a tri-fold greeting card which is capable of being displayed, showing a photograph retaining structure positioned on one of the card panels.

FIG. 10 is a perspective view of the greeting card portion of the blank of FIG. 8, wherein the bi-fold greeting card portion has been removed from the blank along lines of perforation, as is shown being displayed on a detachable display strip removed from the seal flap structure of the blank.

DETAILED DESCRIPTION OF THE INVENTION

Figure 1:
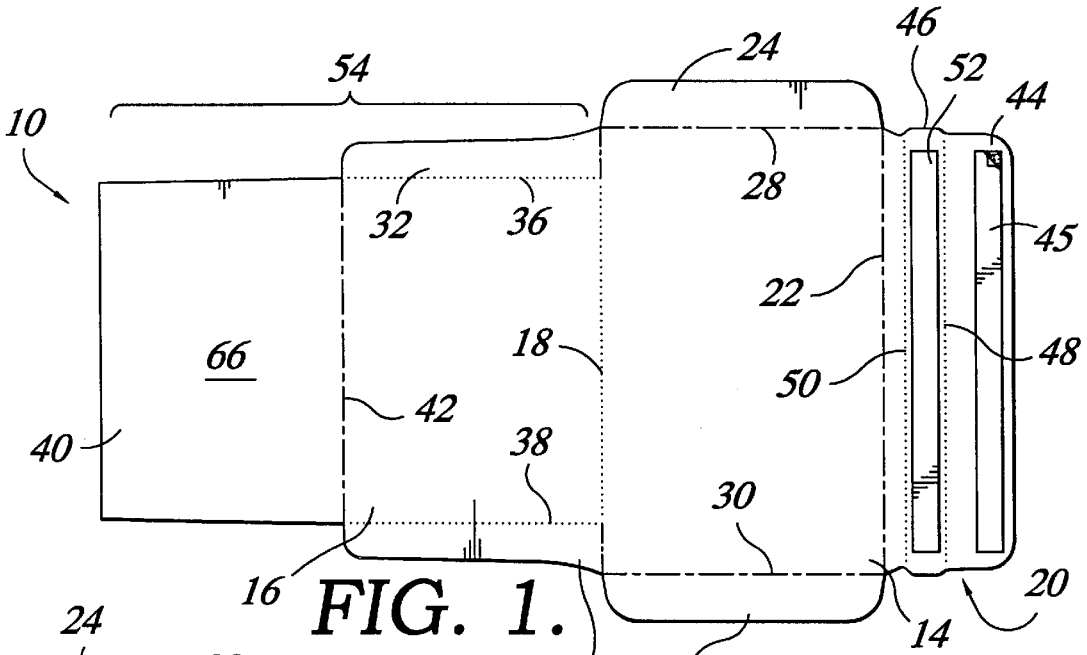
FIG. 1 is a plan view of a blank for use in the construction of the combination envelope and greeting card of the present invention, which is adapted for use first as a mailing envelope and subsequently as a bi-fold greeting card which is capable of being displayed.

Referring now to the drawing depicted in FIG. 1, a blank 10 for making a combination envelope and greeting card is depicted. The blank 10 for the combination envelope/greeting card comprises a front panel 14 and a back panel 16 connected by a perforated fold line 18, a seal flap structure 20 connected at a fold line 22 to front panel 14 opposite back panel 16. First and second side flaps 24, 26 are connected to front panel 14 at fold lines 28 and 30, respectively, and first and second side flap receiving panels 32 and 34 are connected to back panel 16 at perforated lines 36 and 38, respectively. A first card panel 40 is connected at a fold line 42 to back panel 16 opposite front panel 14.

Figure 3:
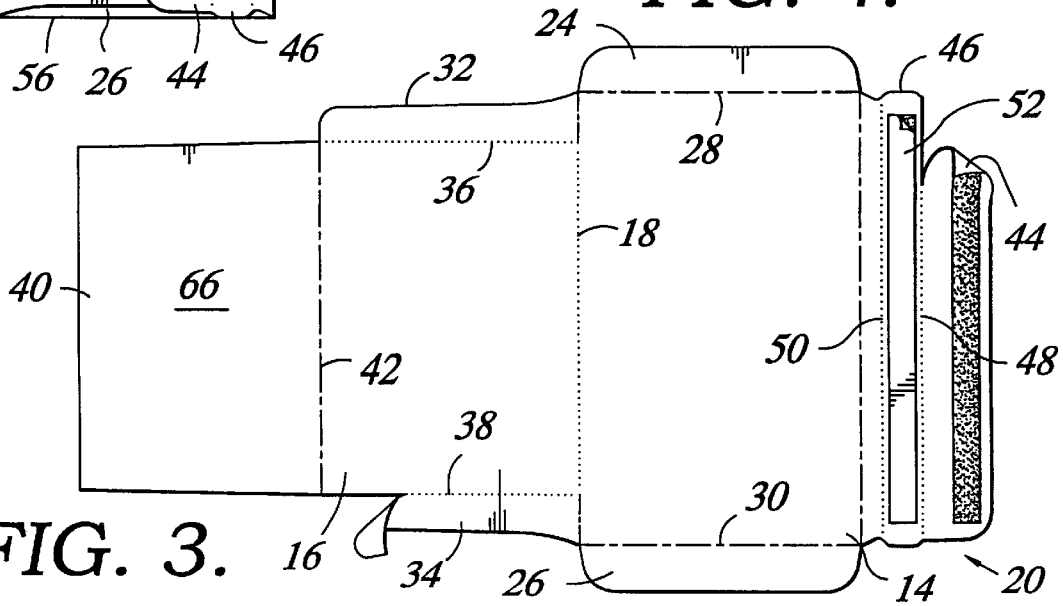
FIG. 3 is plan view of the blank of FIG. 1, depicting portions of a side flap receiving panel and of the seal flap structure being removed from the envelope blank along lines of perforation.

The seal flap structure 20 is comprised of an adhesive seal strip 44 positioned toward the edge of the seal flap structure 20, and a detachable display strip 46 positioned between adhesive seal strip 44 and fold line 22. Adhesive seal strip 44 includes an adhesive seal assembly 45 which can be any suitable adhesive means, including a pressure sensitive adhesive covered by a removable protective strip, a remoistenable strip of glue, or the like. Detachable display strip 46 is bounded on two sides by perforation lines 48 and 50, which are parallel to fold line 22 and extend across the entire width of seal flap structure 20. Detachable display strip 46 includes an adhesive display assembly 52. Similarly, adhesive display assembly 52 can be any suitable adhesive means, including a pressure sensitive adhesive covered by a removable protective strip, a remoistenable strip of glue, or the like. Detachable display strip 46 can be disassociated from the seal flap structure 20 at the perforation lines 48 and 50, and is then available for use in displaying the detachable card structure 54, as will be described below. In FIG. 3, the adhesive seal strip 44 of the seal flap assembly 20 is shown being detached from display strip 46 along perforation line 48. Similarly, in use, display strip 46 can then be completely detached from the envelope at perforation line 50.

Alternatively, the relative positioning of the adhesive seal strip 44 and the detachable display strip 46 could be reversed without departing from the teachings of the present invention. This alternative seal flap structure 20 is equally useful with the envelope blanks depicted in the FIGS. 6, 8 and 9.

A detachable card structure 54 comprises back panel 16 and first card panel 40. Detachable card structure 54 can be disassociated from the blank at lines of perforation 18, 36 and 38. FIG. 3 shows side flap receiving panel 34 being removed from back panel 16 along perforation line 38. Similarly, side flap receiving panel 32 can also be removed from back panel 16 along perforation line 36. Finally, back panel 16 can be detached from front panel 14 along perforated fold line 18. Upon disassociation, detachable card structure 54 functions as a complete, separate greeting card 72, as can best be seen in FIG. 5. The embodiment of the type shown in FIGS. 1–4 includes a greeting card 72 which comprises a bi-fold card. This card can be displayed by standing it up, and if desired to more securely display the card 72 in such a manner, a portion of the bottom of card 72 can be adhered to the adhesive display assembly 52 of the detachable display strip 46 to securely display the card 72.

Figure 2:
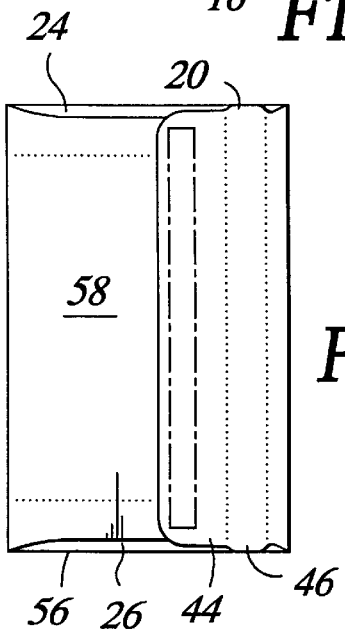
FIG. 2 is a rear view of the blank of FIG. 1, with the side flaps and the seal flap structure folded over and sealed to form an assembled envelope for mailing.

Referring to FIG. 2, the pouch 56 of the envelope of the present invention is formed by folding the side flaps 24 and 26 along fold lines 28 and 30, respectively. Card panel 40 is first folded over back panel 16 along fold line 42, and detachable card structure 54 is then folded over front panel 14 along perforated fold line 18. Side flaps 24 and 26 are thus received by side flap receiving panels 32 and 34, respectively. Alternatively, side flaps 24 and 26 can be positioned over side flap receiving panels 32 and 34. To close the envelope, seal flap structure 20 is folded over the exterior surface 58 of back panel 16 along fold line 22. When it is desired for the envelope to be sealed, adhesive seal assembly strip 45 is adhered to the back panel exterior surface 58.

Of course, it is understood that alternative envelope structures are within the scope of the present invention. As one example, an envelope can be formed from an alternative blank similar to that depicted in FIG. 1, but without side flaps 24 and 26. In this embodiment, side flap receiving panels 32 and 34 would simply be received onto front panel 14. Similar alternatives could be useful in connection with the blanks depicted in FIGS. 6, 8 and 9, discussed below.

What is important with any alternative envelopes suitable for use in connection with the present invention is that the formation of the envelope does not require the use or placement of adhesives on the greeting card structure 72 which would mar the surfaces of that structure 72. Fugitive adhesives, of course, could be positioned on the greeting card structure 72 if needed, as long as the surfaces of the structure 72 are not marred.

Figure 4:
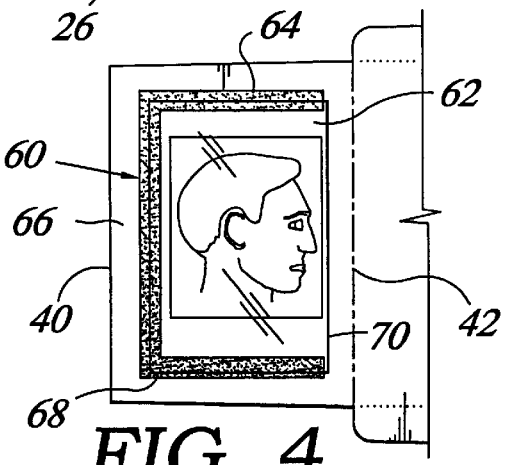
FIG. 4 is a fragmentary plan view of an alternative embodiment of the blank of FIG. 1, depicting a photograph retaining structure incorporated onto one of the card panels.
Figure 5:
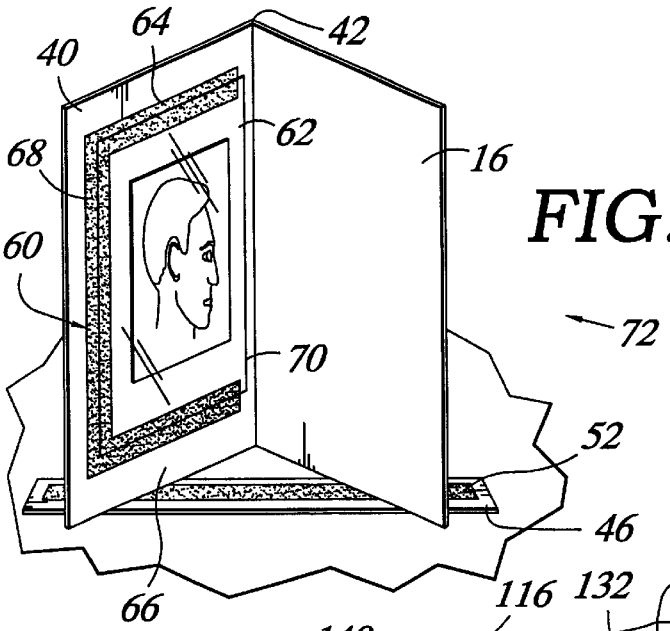
FIG. 5 is a perspective view of the greeting card portion of the type of blanks of FIGS. 1 and 4, wherein the greeting card portion has been removed from the blank along lines of perforation, and is shown being displayed on a detachable display strip removed from the seal flap structure of the blank.

In an alternative embodiment depicted in FIG. 4, card panel 40 includes a photograph retaining structure 60. This structure 60 comprises a transparent cover 62 affixed by an adhesive assembly 64 to the interior surface 66 of the card panel 40. As depicted in the drawing, the adhesive assembly 64 comprises a c-shaped strip of adhesive which fixedly receives a first portion 68 of the periphery of the transparent cover 62 to secure the cover 62 to the interior surface 66 of the card panel 40. A second portion 70 of the periphery of the transparent cover 62 remains open, or unsealed, to allow a photograph or other item to be displayed to be placed or slid under the transparent cover 62. First periphery portion 68 comprises a sufficient amount of the periphery of the cover 62 so as to ensure that the cover 62 and any item displayed thereunder will be secured onto the card panel 40, and second periphery portion 70 comprises a sufficient amount of the periphery of the cover 62 so as to allow the item to be displayed to be inserted under the cover 62, while being securely retained therein. It is understood that the photograph retaining structure 60 can be positioned on either first card panel 40 or back panel 16, or alternatively, both panels 16 and 40 can include a photograph retaining structure.

While the photograph retaining structure 60 is shown as being generally rectangular in shape, it is understood that any suitable shape is within the scope and understanding of the present invention. Likewise, the adhesive assembly 64 which is to be associated with any such shape of the photograph retaining structure 60 can be of any shape which is suitable to secure the corresponding photograph retaining structure 60.

Figure 6:
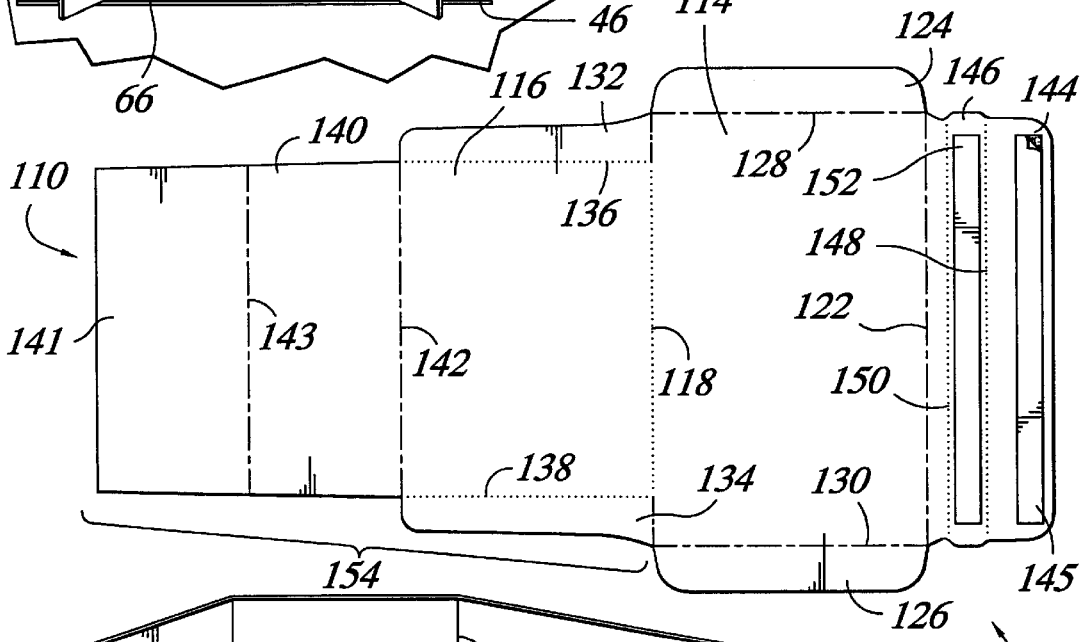
FIG. 6 is a plan view of an alternative embodiment of a blank for use in the construction of the combination envelope and greeting card of the present invention, which is adapted for use first as a mailing envelope and subsequently as a tri-fold greeting card which is capable of being displayed.
Figure 7:
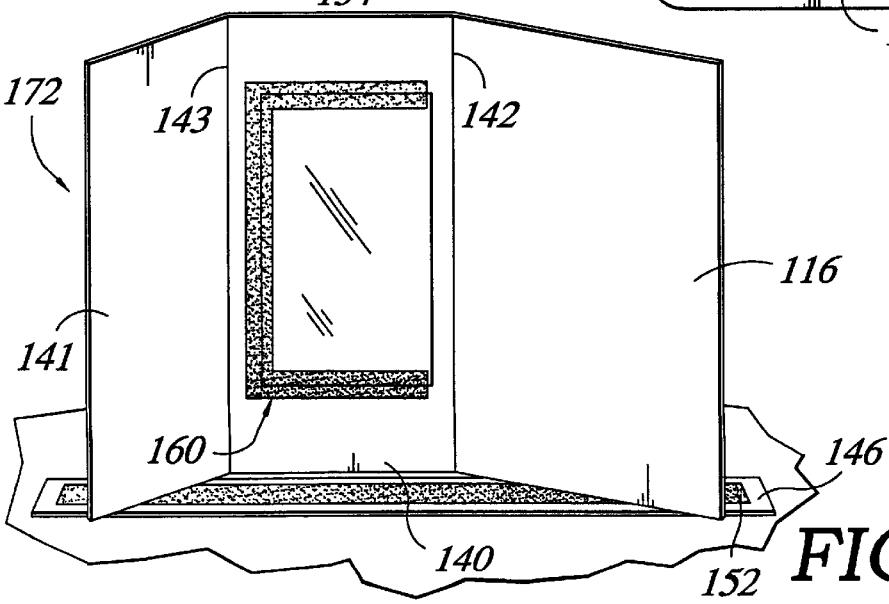
FIG. 7 is a perspective view of the greeting card portion of the blank of FIG. 6, wherein the tri-fold greeting card portion has been removed from the blank along lines of perforation, and is shown being displayed on a detachable display strip removed from the seal flap structure of the blank.

In another aspect of the present invention, as shown in FIGS. 6 and 7, more than one card panel can be included in the combination envelope and greeting card of the present invention. This embodiment provides an envelope blank 110 similar to that depicted in FIG. 1 above. The blank 110 for this embodiment comprises a front panel 114 and a back panel 116 connected by a perforated fold line 118, a seal flap structure 120 connected at a fold line 122 to front panel 114 opposite back panel 116. First and second side flaps 124 and 126 are connected to front panel 114 at fold lines 128 and 130, respectively, and first and second side flap receiving panels 132 and 134 are connected to back panel 116 at perforated lines 136 and 138, respectively. A first card panel 140 is connected at a fold line 142 to back panel 116 opposite front panel 114. A second card panel 141 is connected at a fold line 143 to first card panel 140 opposite back panel 116.

The seal flap structure 120 is similar to that in the first embodiment depicted in FIGS. 1 and 3, and includes an adhesive seal strip 144 positioned toward the edge of the seal flap structure 120, and a detachable display strip 146 positioned between adhesive seal assembly 144 and fold line 122. Adhesive seal strip 144 includes an adhesive seal assembly 145 which can be any suitable adhesive means, including a pressure sensitive adhesive covered by a removable protective strip, a remoistenable strip of glue, or the like. Detachable display strip 146 is bounded on two sides by perforation lines 148 and 150, which are parallel to fold line 122 and extend across the entire width of seal flap structure 120. Detachable display strip 146 includes an adhesive display assembly 152. Similarly, the adhesive display assembly 152 can be any suitable adhesive means, including a pressure sensitive adhesive covered by a removable protective strip, a remoistenable strip of glue, or the like. Detachable display strip 146 can be disassociated from the seal flap structure 120 at the perforation lines 148 and 150, and is then available for use in displaying the detachable card structure 154, as will be described below.

The detachable card structure 154 of this embodiment comprises back panel 116, first card panel 140, and second card panel 141. As discussed above with respect to the first embodiment, the detachable card structure 154 can be disassociated from the blank 110 at lines of perforation 118, 136 and 138. Upon disassociation, detachable card structure 154 functions as a complete, separate tri-fold greeting card 172. As can best be seen in FIG. 7, tri-fold greeting card 172 can be displayed by standing it up, and if desired to more securely display the card 172 in such a manner, a portion of the bottom of card 172 can be adhered to the adhesive display assembly 152 of the display strip 146 to securely display the card 172. Although not depicted in the drawings, card panels 140, 141 or back panel 116, or any combination of these panels, can include a photograph retaining structure 160 similar to that described above.

In the embodiment depicted in FIG. 6, the envelope can be similarly formed, with second card panel 141 first being folded over first card panel 140 along fold line 143, and then this combination of panels 140 and 141 is next folded over back panel 116 along fold line 142. As with the embodiment in FIG. 2, the detachable card structure 154 can then be folded over front panel 114 along perforated fold line 118. Side flaps 124 and 126 are thus received by side flap receiving panels 132 and 134, respectively. To close the envelope, seal flap structure 120 is folded over the exterior surface of back panel 116 along fold line 122. When it is desired for the envelope to be sealed, adhesive seal assembly strip 145 is adhered to the exterior surface of back panel 116.

Turning now to FIG. 8, an alternate embodiment of the present invention is shown. A blank 210 is depicted and comprises a front panel 214 and a back panel 216 connected by a fold line 219, a seal flap structure 220 (similar to those discussed in connection with the above embodiments) connected at a perforated fold line 223 to front panel 214 opposite back panel 216. Seal flap structure 220 includes an adhesive seal strip 244 positioned toward the edge of the seal flap structure 220, and a detachable display strip 246 positioned between adhesive seal assembly 244 and fold line 222. Adhesive seal strip 244 includes an adhesive seal assembly 245 which can be any suitable adhesive means, including a pressure sensitive adhesive covered by a removable protective strip, a remoistenable strip of glue, or the like. Detachable display strip 246 is bounded on two sides by perforation lines 248 and 250, which are parallel to fold line 222 and extend across the entire width of seal flap structure 220. Detachable display strip 246 includes an adhesive display assembly 252. Similarly, the adhesive display assembly 252 can be any suitable adhesive means, including a pressure sensitive adhesive covered by a removable protective strip, a remoistenable strip of glue, or the like. Detachable display strip 246 can be disassociated from the seal flap structure 220 at the perforation lines 248 and 250, and is then available for use in displaying the detachable card structure 254, as will be described below. First and second side flaps 224, 226 are connected to front panel 214 at fold lines 228 and 230, respectively, and first and second side flap receiving panels 232 and 234 are connected to back panel 216 at perforated lines 236 and 238, respectively. Perforated lines 236 and 238 also extend across front panel 214 from fold line 219 to perforated fold line 223. Photograph retaining structure 260 (similar to that discussed above in connection with the previous embodiment) is shown positioned on front panel 214. It is not essential that the photograph retaining structure 260 be positioned on the front panel 214. As an alternative to the blank displayed in FIG. 8, the photograph retaining structure 260 can instead be positioned on the back panel 216, or separate photograph retaining structures 260 can be positioned on both on panels 214 and 216. In yet another alternative embodiment, the blank does not include a photograph retaining structure.

A detachable card structure 254 comprises front panel 214 and back panel 216, and can be disassociated from the blank 210 at lines of perforation 223, 236 and 238. Upon disassociation, detachable card structure 254 functions as a complete, separate greeting card 272, as can best be seen in the embodiment of FIG. 10. Greeting card 272 comprises a bi-fold card which can be displayed by standing it up, and if desired to more securely display the card 272 in such a manner, a portion of the bottom of card 272 can be adhered to the adhesive display assembly 252 of the detachable display strip 246 to securely display the card 272.

Referring now to FIG. 9, another embodiment of the present invention is depicted, wherein a blank 310 comprises a front panel 314 and a back panel 316 connected by a fold line 319, and a seal flap structure 320 (similar to those discussed in connection with the above embodiments) connected at a perforated fold line 323 to front panel 314 opposite back panel 316. First and second side flaps 324, 326 are connected to front panel 314 at fold lines 328 and 330, respectively, and first and second side flap receiving panels 332 and 334 are connected to back panel 316 at perforated lines 336 and 338, respectively. Perforated lines 336 and 338 also extend across front panel 314 from fold line 319 to perforated fold line 323. A first card panel 340 is connected at a fold line 342 to back panel 316 opposite front panel 314. Photograph retaining structure 360 (similar to that discussed above in connection with the previous embodiments) is shown positioned on front panel 314. It is not essential that the photograph retaining structure 360 be positioned on the front panel 314. As an alternative to the blank displayed in FIG. 9, the photograph retaining structure 360 can instead be positioned on the back panel 316 or the first card panel 340, or on any combination of the panels 314, 316 and 340. In yet another alternative embodiment, the blank does not include a photograph retaining structure.

A detachable card structure 354 comprises front panel 314, back panel 316 and first card panel 340. This card structure 354 can be disassociated from the blank 310 at lines of perforation 323, 336 and 338. Upon disassociation, detachable card structure 354 functions as a complete, separate tri-fold greeting card. Although not depicted in the drawings, as with the previous embodiments, this tri-fold greeting card can be displayed using the detachable display strip 346 and associated adhesive display assembly 352.

The combination envelope and greeting card of the present invention is adapted for use first as an envelope, if so desired. Subsequent to such use, or as an alternative to such use, the greeting card portion can be utilized as follows. With the embodiments shown in FIGS. 1–7, the combination envelope and greeting card can be sold in the form of a kit, wherein the envelope blank is either not folded or is folded with the sides unsealed, allowing the greeting card to be personalized by the sender prior to the formation of the envelope. In the embodiment depicted in FIGS. 4 and 5, wherein a photograph retaining structure is included, a photograph or other item to be displayed can be positioned under the transparent cover prior to formation of the envelope by folding the blank. Alternatively, the envelope can be preformed and presealed, eliminating the ability to include any personalization on the inside of the card.

With the embodiments shown in FIGS. 8–10, the envelope can either be sold as a kit (i.e., unfolded or folded with the sides unsealed, as discussed above), or alternatively the envelope can first be formed from the blank prior to use. In this situation, the positioning of the photograph retaining structure 260, 360 on the front panel 214, 314 of the blank allows the user to access an unsealed portion of the periphery of the transparent cover 270, 370 for inserting a photograph or other item to be retained therein, even after the blank has been formed into an envelope with the sides sealed.

From the foregoing, it will be seen that this invention is one well adapted to attain all the ends and objects hereinabove set forth, together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A combination envelope and greeting card made from a blank comprising:

a front panel having opposed side edges and a back panel having opposed side edges, the front and back panels being connected along a line of perforation, two side flap receiving panels extending from the back panel at the side edges thereof, each side flap receiving panel connected thereto along a second line of perforation, the side flap receiving panels adapted to receive a portion of the front panel when the blank is formed into an envelope, a seal flap structure extending from the front panel opposite the back panel and connected thereto at a first fold line, and a detachable card structure extending from the front panel, the detachable card structure comprising a portion of the back panel, and at least one card panel extending from the back panel opposite the front panel and connected thereto along a second fold line.

2. The combination envelope and greeting card as set forth in claim 1, wherein the front panel further comprises two side flaps extending from therefrom at the side edges thereof, each side flap connected thereto along a third fold line.

3. The combination envelope and greeting card as set forth in claim 1, wherein the seal flap structure further comprises an adhesive strip assembly and a detachable display strip portion.

4. The combination envelope and greeting card as set forth in claim 1, wherein the detachable card structure further comprises a second card panel extending from the first card panel, the second card panel being connected to the first card panel along a fourth fold line.

5. The combination envelope and greeting card as set forth in claim 1, wherein one or more of the panels includes a photograph retaining structure.

6. The combination envelope and greeting card as set forth in claim 5, the photograph retaining structure comprising a clear cover adhered around a first portion of the perimeter thereof to one of the panels, with a second portion of the perimeter of the cover remaining unadhered for receiving and displaying a photograph or other item thereunder.

7. A combination envelope and greeting card made from a blank comprising:

a front panel having opposed side edges and a back panel having opposed side edges, the front and back panels being connected along a first fold line, a seal flap structure extending from the front panel opposite the back panel and connected thereto along a first line of perforation, two side flap receiving panels extending from the back panel at the side edges thereof, each side flap receiving panel connected thereto along second lines of perforation, the side flap receiving panels adapted to receive a first portion of the front panel when the blank is formed into an envelope, the second lines of perforation also extending across the front panel from the first fold line to the first line of perforation, a detachable card structure extending from the front panel, the detachable card structure comprising the a portion of the back panel and a second portion of the front panel.

8. The combination envelope and greeting card as set forth in claim 7, wherein the front panel further comprises two side flaps extending therefrom at the side edges thereof, the side panels each connected thereto along second fold lines.

9. The combination envelope and greeting card as set forth in claim 7, wherein the seal flap structure further comprises an adhesive strip assembly and a detachable display strip portion.

10. The combination envelope and greeting card as set forth in claim 7, wherein the detachable card structure further comprises a first card panel extending from the back panel, the first card panel being connected to the back panel along a third fold line.

11. The combination envelope and greeting card as set forth in claim 7, wherein one or more of the panels includes a photograph retaining structure.

12. The combination envelope and greeting card as set forth in claim 11, the photograph retaining structure comprising a clear cover adhered around a first portion of the perimeter thereof to one of the panels, with a second portion of the perimeter of the cover remaining unadhered for receiving and displaying a photograph or other item thereunder.

* * * * *

UNITED STATES PATENT AND TRADEMARK OFFICE

CERTIFICATE OF CORRECTION

PATENT NO. : 6,725,587 B2
DATED : April 27, 2004
INVENTOR(S) : Robert W. Collins It is certified that error appears in the above-identified patent and that said Letters Patent is hereby corrected as shown below:

Title page,
Item [73], Assignee, change "Winkler & Dunnebier, AG" to -- Winkler + Dunnebier, AG --

Signed and Sealed this

Nineteenth Day of October, 2004

JON W. DUDAS
*Director of the United States Patent and Trademark Office*